US007737919B2

(12) United States Patent
Park

(10) Patent No.: US 7,737,919 B2
(45) Date of Patent: Jun. 15, 2010

(54) PLASMA DISPLAY AND DRIVING METHOD THEREOF

(75) Inventor: Seung-Ho Park, Chunan-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 895 days.

(21) Appl. No.: 11/495,923

(22) Filed: Jul. 27, 2006

(65) Prior Publication Data

US 2007/0024534 A1 Feb. 1, 2007

(30) Foreign Application Priority Data

Jul. 29, 2005 (KR) ..... 10-2005-0069526

(51) Int. Cl.
*G09G 3/28* (2006.01)

(52) U.S. Cl. ..... 345/63; 345/60; 345/61; 345/62; 345/55

(58) Field of Classification Search ..... 345/60–63, 345/55

See application file for complete search history.

(56) References Cited

U.S. PATENT DOCUMENTS

2003/0122743 A1* 7/2003 Suzuki ..... 345/63

FOREIGN PATENT DOCUMENTS

| | | |
|---|---|---|
| EP | 1 014 330 A2 | 6/2000 |
| EP | 1 139 322 A2 | 10/2004 |
| EP | 1 519 355 A1 | 3/2005 |
| GB | EP 1 519 355 A1 * | 9/2004 |
| JP | 2003-177697 | 6/2003 |

OTHER PUBLICATIONS

European Search Report dated Nov. 21, 2006, for 06117936.2 in the name of Samsung SDI Co., Ltd.

Patent Abstracts of Japan, Publication No. 2003-177697, dated Jun. 27, 2003, in the name of Takahiko Yamamuro.

* cited by examiner

*Primary Examiner*—Richard Hjerpe
*Assistant Examiner*—Leonid Shapiro
(74) *Attorney, Agent, or Firm*—Christie, Parker & Hale, LLP

(57) ABSTRACT

A plasma display device and a driving method thereof are provided. An input grayscale value is converted according to a peak grayscale value of an input video signal of one frame. The number of on-subfields may be increased as a result of the grayscale conversion. Therefore, a total number of sustain discharge pulses applied during the one frame is reset in order to obtain the same brightness for the input and converted grayscale values.

16 Claims, 5 Drawing Sheets

| APC Level | First sustain discharge pulse number | Second sustain discharge pulse number |
|---|---|---|
| 0 | sus_apc0 | sus_apc0' |
| 1 | sus_apc1 | sus_apc1' |
| 2 | sus_apc2 | sus_apc2' |
| ⋮ | ⋮ | ⋮ |
| 254 | sus_apc254 | sus_apc254' |
| 255 | sus_apc255 | sus_apc255' |

FIG.3

| APC Level | First sustain discharge pulse number | Second sustain discharge pulse number |
|---|---|---|
| 0 | sus_apc0 | sus_apc0' |
| 1 | sus_apc1 | sus_apc1' |
| 2 | sus_apc2 | sus_apc2' |
| ⋮ | ⋮ | ⋮ |
| 254 | sus_apc254 | sus_apc254' |
| 255 | sus_apc255 | sus_apc255' |

FIG.5

| Subfield | SF1 | SF2 | SF3 | SF4 | SF5 | SF6 | SF7 | SF8 | SF9 | SF10 |
|---|---|---|---|---|---|---|---|---|---|---|
| Weight value / Glayscale | 1 | 2 | 4 | 8 | 16 | 32 | 42 | 44 | 52 | 54 |
| 0 | × | × | × | × | × | × | × | × | × | × |
| 1 | ○ | × | × | × | × | × | × | × | × | × |
| 2 | × | ○ | × | × | × | × | × | × | × | × |
| 3 | ○ | ○ | × | × | × | × | × | × | × | × |
| 4 | × | × | ○ | × | × | × | × | × | × | × |
| ... | ... | ... | ... | ... | ... | ... | ... | ... | ... | ... |
| 127 | ○ | × | × | ○ | × | ○ | ○ | ○ | × | × |
| 128 | × | ○ | × | ○ | × | ○ | ○ | ○ | × | × |
| ... | ... | ... | ... | ... | ... | ... | ... | ... | ... | ... |
| 254 | × | ○ | ○ | ○ | ○ | ○ | ○ | ○ | ○ | ○ |
| 255 | ○ | ○ | ○ | ○ | ○ | ○ | ○ | ○ | ○ | ○ |

I

II

Lpeak

Lpeak'

PLASMA DISPLAY AND DRIVING METHOD THEREOF

CROSS-REFERENCE TO RELATED APPLICATION

This application claims priority to and the benefit of Korean Patent Application No. 10-2005-0069526 filed in the Korean Intellectual Property Office on Jul. 29, 2005, the entire content of which is incorporated herein by reference.

BACKGROUND OF THE INVENTION (a) Field of the Invention

The present invention relates to a plasma display device and a driving method thereof and more particularly to a driving method that manipulates the grayscale values of an input video signal.

(b) Description of the Related Art

In a plasma display device, a video signal of one frame input to the plasma display device, i.e. an input video signal, is divided between a plurality of subfields each having a corresponding weight. Grayscales are expressed according to an on/off state of the subfields and a combination of weights of the on-subfields. Each subfield includes a reset period, an address period, and a sustain period. The reset period is for initializing the state of each discharge cell so as to facilitate an addressing operation on the discharge cell. The address period is for selecting turn-on/turn-off cells (i.e., cells to be turned on or off) and accumulating wall charges in the turn-on cells (i.e., addressed cells). The sustain period is for causing a discharge for displaying an image on the addressed cells.

However, when as described above data from the input video signal of one frame is divided between a plurality of subfields and grayscales are displayed according to an on/off state of the subfields, a false contour may be generated due to the characteristics of human visual perception. That is, when a moving image is displayed, a false contour phenomenon may occur in which a grayscale that is different from an actual one is perceived by human eyes.

In addition, when the grayscales are displayed according to the on/off state of the subfields, if the number of the on-subfields is small, then a small amount of priming particles are generated, and accordingly, a sufficient discharge may not be generated.

SUMMARY OF THE INVENTION

The present invention provides a plasma display device and a driving method thereof that reduce perception of false contour and enhance light emitting characteristics.

One exemplary embodiment provides a driving method for a plasma display device. The plasma display device is driven by an input video signal during each one frame. Each frame is divided into a plurality of subfields. The input video signal of each frame is divided among the plurality of subfields. Each input video signal corresponds to input grayscales. The driving method detects a peak value that is a highest grayscale among the input grayscales of the input video signal of the one frame. Then, the driving method converts the input grayscale of the one frame according to the peak value and generates a converted grayscale. Finally, the converted grayscale is applied to the plasma display device.

In a further embodiment, during the converting of the input grayscale, the same number of sustain discharge pulses may be allocated for the originally input and converted grayscales. In addition, the driving method may include detecting a load ratio of the input video signal of the one frame, determining a first sustain discharge pulse number and applying the first sustain discharge pulse number to the plasma display device. The first sustain discharge pulse number is a total number of sustain discharge pulses finally applied during the one frame corresponding to the load ratio and the peak value.

One exemplary embodiment provides a driving method for a plasma display device. The plasma display device is driven by an input video signal during each one frame that is in turn divided into a plurality of subfields. Each input video signal corresponds to a plurality of input grayscales. The driving method detects a first peak value that is a highest grayscale among input grayscales of the input video signal of a first frame and converts an input grayscale of the first frame according to the detected first peak value. The driving method also detects a second peak value that is a highest grayscale among input grayscales of the input video signal of a second frame and converts an input grayscale of the second frame corresponding to the second peak value. A first grayscale below the first peak value of the first frame is converted into a second grayscale, and a same grayscale as the first grayscale of the first frame is converted into a third grayscale for the second frame. When the second peak value is greater than the first peak value, then the third grayscale of the second frame is less than the second grayscale of the first frame.

In a further embodiment, substantially the same brightness is expressed for the second and third grayscales when the first and second frames have the same load ratio. In addition, the total number of sustain discharge pulses applied during the second frame may be greater than that applied during the first frame when the first and second frames have the same load ratio and the second peak value is greater than the first peak value.

An exemplary plasma display device according to an embodiment of the present invention is also provided. The plasma display device includes a plasma display panel (PDP) having a plurality of discharge cells, a controller for generating a control signal from input video signal of one frame, and a driver for driving the PDP responsive to the control signal of the controller. The control signal controls the PDP by driving a plurality of subfields. The controller detects the highest grayscale value among the grayscale values of the input video signal of the one frame as a peak value, converts the grayscale of the input video signal of the one frame corresponding to the peak value, and applies the converted grayscale to the PDP. In a further embodiment, the same number of sustain discharge pulses may be allocated to the originally input and converted grayscales. In addition, the controller includes a peak value detector for detecting the peak value, an automatic power controller for detecting a load ratio of the input video signal of the one frame, a first sustain discharge pulse number determiner for detecting a a total number of the sustain discharge pulses applied during the one frame according to the load ratio as a first sustain discharge pulse number, a grayscale value converter for converting the grayscale of the input video signal of the one frame in correspondence to the peak value, and a second sustain discharge pulse number determiner for determining a second sustain discharge pulse number that is a total number of sustain discharge pulses finally applied during the one frame in correspondence to the peak value and the first sustain discharge pulse number.

BRIEF DESCRIPTION OF THE DRAWINGS

FIG. 3 shows the relationship between first and second sustain discharge pulse numbers and automatic power control (APC) levels according to an exemplary embodiment of the present invention.

FIG. 5 shows the increase in the number of on-subfields when grayscales corresponding to the subfields are converted according to the method shown in FIG. 4.

DETAILED DESCRIPTION

In the following description, a waveform applied to an electrode to generate a sustain discharge during a sustain period is referred to as a sustain discharge pulse. However, various waveforms including but not limited to a pulse may be used. In addition, the number of sustain discharge pulses is used to indicate the number of sustain discharges generated during the sustain period because a single sustain discharge pulse generates a single sustain discharge in a sustain period.

Figure 1:
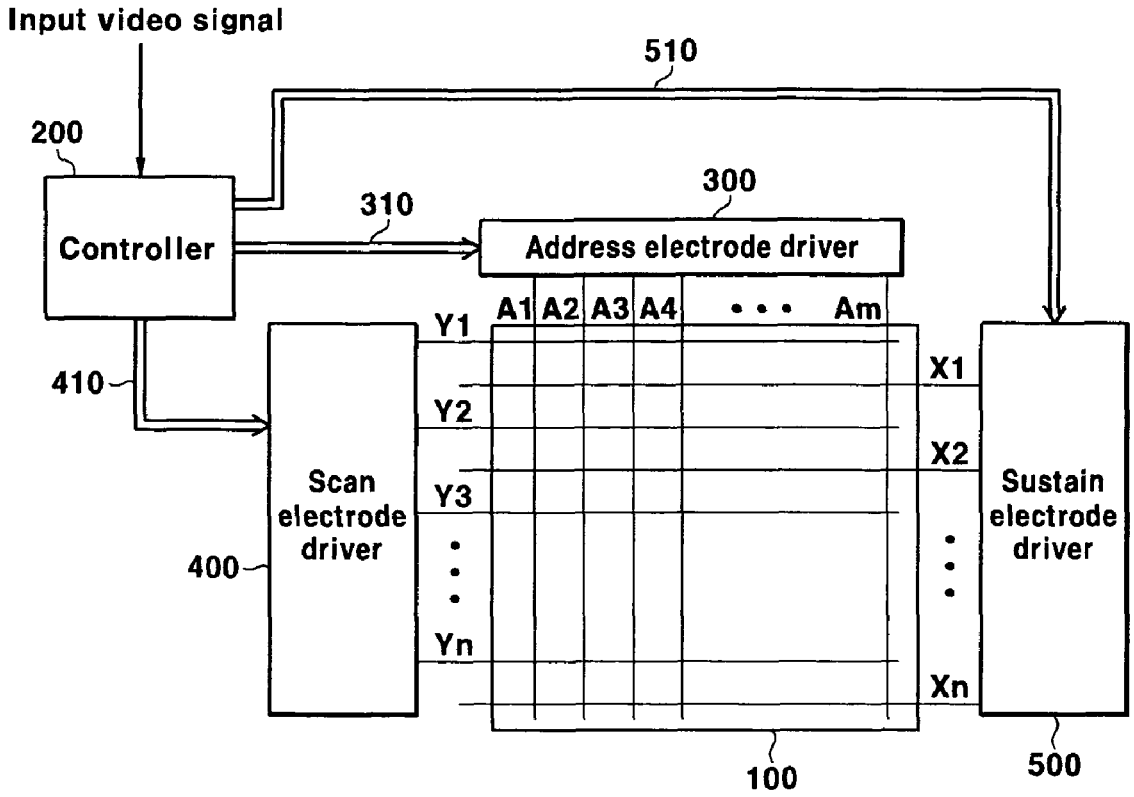
FIG. 1 schematically shows a plan view of a plasma display device according to an exemplary embodiment of the present invention.

FIG. 1 schematically shows a plan view of a plasma display device according to an exemplary embodiment of the present invention.

A plasma display device according to an exemplary embodiment of the present invention includes a plasma display panel (PDP) 100, a controller 200, an address electrode driver 300, a scan electrode driver 400, and a sustain electrode driver 500.

The PDP 100 includes a plurality of address electrodes A1 to Am extending in a column direction, and a plurality of scan and sustain electrodes Y1 to Yn and X1 to Xn extending in a row direction. Typically, the sustain electrodes X1 to Xn are formed in correspondence to their respective scan electrodes Y1 to Yn and form pairs of sustain and scan electrodes. Further, ends of the sustain electrodes X1 to Xn are coupled to one another. In addition, the PDP 100 includes one substrate (not shown) having the sustain and scan electrodes X1 to Xn and Y1 to Yn formed thereon, and another substrate (not shown) having the address electrodes A1 to Am formed thereon. The two substrates face each other while interposing a discharge space such that a direction of the address electrodes A1 to Am perpendicularly crosses a common direction of the scan electrodes Y1 to Yn and sustain electrodes X1 to Xn. Discharge spaces formed at areas where the address electrodes A1 to Am cross over the sustain electrodes X1 to Xn and scan electrodes Y1 to Yn form discharge cells. The PDP 100 presents only one exemplary structure for a PDP of the present invention, and panels of other structures may be used in the present invention as well.

The address electrode driver 300 receives an address electrode driving control signal 310 from the controller 200, and applies a display data signal for selecting discharge cells to be discharged to each address electrode A1 to Am. The scan electrode driver 400 receives a scan electrode driving control signal 410 from the controller 200, and applies the driving voltage to the scan electrodes Y1 to Yn. The sustain electrode driver 500 receives a sustain electrode driving control signal 510 from the controller 200, and applies a driving voltage to the sustain electrodes X1 to Xn.

The controller 200 receives an input video signal and outputs the address electrode driving control signal 310, the scan electrode driving control signal 410, and the sustain electrode driving control signal 510. The input video signal is an image signal including R, G, and B data. One input video signal drives one frame of the PDP and may include a plurality of grayscale values. The controller 200 divides each one frame into a plurality of subfields which are subject to time-division control. Each subfield is divided into a reset period, an address period, and a sustain period. In order to reduce perception of a false contour and enhance discharge characteristics, the controller 200 converts the input video signal (R, G, B data) depending on a peak value of one frame, and changes a total number of sustain discharge pulses applied during the one frame depending on a load ratio and the peak value of the one frame. The peak value of a frame is the peak value of the input video signal during the frame.

A method for reducing a false contour and enhancing discharge characteristics using the controller 200 of the plasma display device according to an exemplary embodiment of the present invention will be described with reference to FIG. 2 through FIG. 5.

Figure 2:
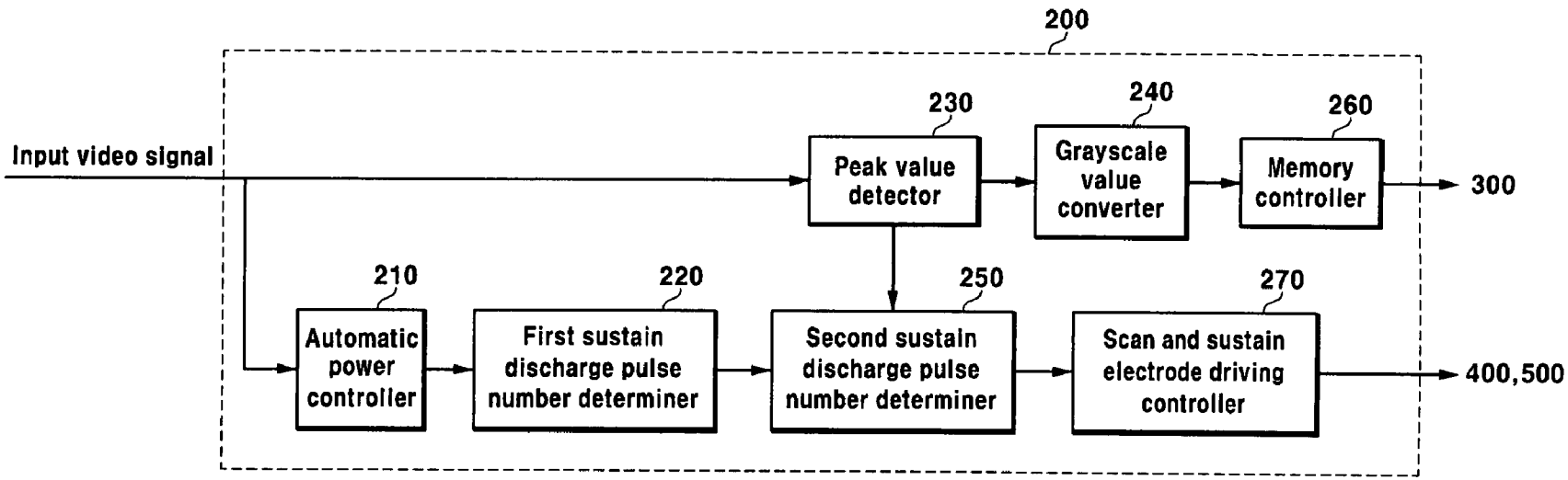
FIG. 2 schematically shows a block diagram of a controller of a plasma display device according to an exemplary embodiment of the present invention.
Figure 4:
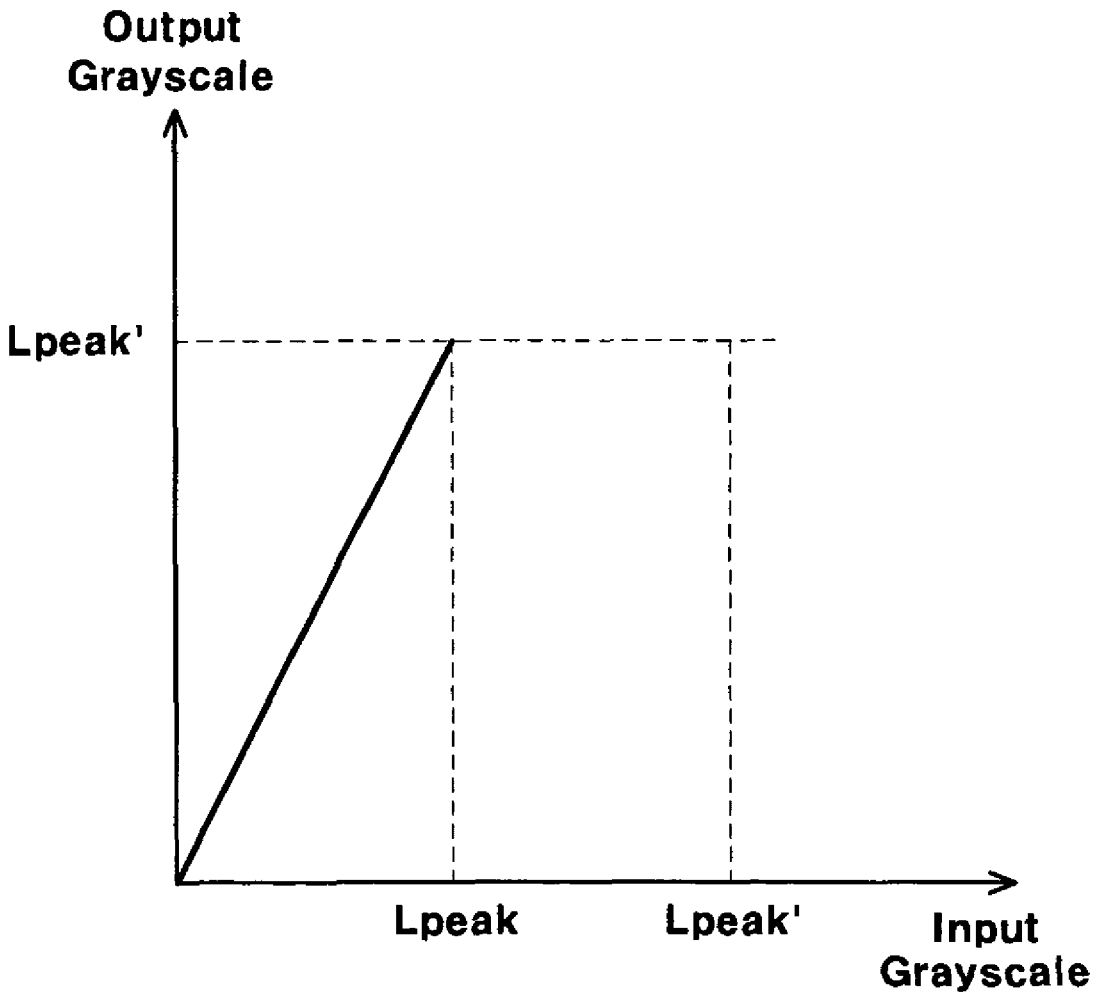
FIG. 4 is a plot showing a method of converting grayscale values according to a peak value of an input video signal according to an exemplary embodiment of the present invention.

FIG. 2 schematically shows a block diagram of a controller of a plasma display device. FIG. 3 shows the relationship between first and second sustain discharge pulse numbers and automatic power control (APC) levels. The first and second sustain discharge pulse numbers refer to the number of first sustain discharge pulses and the number of second sustain discharge pulses applied during one frame. The first sustain discharge pulse number is determined according to the APC levels and the second sustain discharge pulse number is determined from the first sustain discharge pulse number according to the peak values of the input video signals. FIG. 4 is a plot showing a method of converting grayscale values according to the peak value, and FIG. 5 shows that the number of on-subfields is increased when grayscales of the subfields are changed according to the plot of FIG. 4.

As shown in FIG. 2, the controller 200 of the plasma display device according to an exemplary embodiment of the present invention includes an automatic power controller 210, a first sustain discharge pulse number determiner 220, a peak value detector 230, a grayscale value converter 240, a second sustain discharge pulse number determiner 250, a memory controller 260, and a scan and sustain electrode driving controller 270.

The automatic power controller 210 receives the input video signal and calculates an average signal level (ASL) for the frames being driven by the input video signals (R, G, B data), and detects an APC level according to the calculated ASL.

The ASL for each one frame is calculated by Equation 1.

$$ASL = \sum_{x=1}^{N} \sum_{y=1}^{M} \frac{R_{x,y} + G_{x,y} + B_{x,y}}{3 \times N \times M} \quad \text{(Equation 1)}$$

In Equation 1, $R_{x,y}$, $G_{x,y}$, and $B_{x,y}$ are respectively R, G, and B grayscale values in a discharge cell having a position (x, y), and N and M are the number of discharge cells respectively along the column and row directions of the PDP.

Then, the automatic power controller 210 detects the APC levels corresponding to the ASL calculated by Equation 1. In one exemplary embodiment, the APC levels are previously established as levels 0 to 255 according to the calculated ASL. In FIG. 3, the APC levels are expressed as 0 to 255 while, this is but one example, and the range of values of the APC levels may be varied. FIG. 3 tabulates the number of the first sustain discharge pulses and the number of the second sustain discharge pulses, or the first and second sustain discharge pulse numbers, according to the APC level. The first and second sustain discharge pulse numbers are expressed as symbols (sus_apc0, sus_apc1, sus_apc2 . . . sus_apc254, sus_apc255 and sus_apc0', sus_apc1', sus_apc2' . . . sus_apc254', sus_apc255'), while the symbols represent numbers. The number of the first sustain discharge pulses are determined according to the APC levels and the number of second sustain discharge pulses are determined based on the first sustain discharge number and according to peak values of the input video signals. In addition, a method for detecting whether the input video signal data generally have higher power consumption is related to a method for detecting the load ratio. According to one exemplary embodiment of the present invention, the load ratio is detected from the ASL. However, other data of the subfields may also be used to detect the load ratio.

The first sustain discharge pulse number determiner 220 receives the APC level information from the automatic power controller 210, and determines the number of first sustain discharge pulses, also referred to as the first sustain discharge pulse number, corresponding to the APC level. The number of the first sustain discharge pulses, that corresponds to the received APC level, implies the total number of sustain discharge pulses applied during one frame. Because a higher APC level indicates that the input video signal has a higher load ratio and a pattern of higher power consumption, the first sustain discharge pulse number is set to be smaller for the higher APC levels in order to maintain the power consumption below a level that may be predetermined. Therefore, in FIG. 3, the first sustain discharge pulse number corresponding to the APC level of 0 is smaller than the first sustain discharge pulse number corresponding to the APC level of 255. In other words, the pulse numbers decrease from sus_apc0 to sus_apc255.

In the exemplary embodiment described above, the automatic power controller 210 determines the APC levels from the input video signal data (R,G,B data) and the first sustain discharge pulse number determiner 220 determines the first sustain discharge pulse number corresponding to the APC levels. In other embodiments, however, the automatic power controller 210 may not detect the APC levels corresponding to the load ratio, rather it may detect only the load ratio and transmit information corresponding to the load ratio to the first sustain discharge pulse number determiner 220. Then, the first sustain discharge pulse number determiner 220 may determine the number of first sustain discharge pulses, i.e. the first sustain discharge pulse number, corresponding to the load ratio information received from the automatic power controller 210.

The peak value detector 230 detects a peak value (Lpeak), that is, the highest grayscale value for each of the frames from among the input video signal data (R,G,B data) for that frame. That is, the peak value detector 230 detects the highest grayscale value from among the video signal data of one frame. A method for detecting the peak value of one frame is obvious to a person of ordinary skill in the art, and accordingly is not described in further detail.

The grayscale value converter 240 receives the peak value Lpeak from the peak value detector 230 as an input grayscale value, and converts the Lpeak value to an output grayscale value so as to increase the number of on-subfields. FIG. 4 plots a curve of the output grayscale versus the input grayscale. The input grayscale indicates a grayscale that has not been converted by the grayscale value converter 240, and the output grayscale indicates a grayscale that has been converted by the converter 240. The curve includes a linear increase in the output grayscale with increase in the input grayscale up to an input grayscale of Lpeak. As shown in FIG. 4, for any one frame, the input grayscale peak value, Lpeak, is converted into the highest grayscale, Lpeak', used by the PDP, and the input grayscales below the peak value Lpeak are converted into output grayscale values proportional to the input grayscale. In the exemplary embodiment described, Lpeak' is 255. The grayscale value converter 240 converts the input grayscale value according to the peak value Lpeak. As a result, the output grayscale value for inputs up to the input grayscale peak value Lpeak is given by Equation 2.

$$\text{Output grayscale value} = (L\text{peak}'/L\text{peak}) \times \text{Input grayscale value} \quad \text{(Equation 2)}$$

In Equation 2, Lpeak is the peak value detected by the peak value detector 230, and Lpeak' is the highest grayscale value from among the grayscale values that are used by the PDP. That is, when the grayscales 0 to 255 are being used, Lpeak' is equal to 255, and when the grayscales 0 to 511 are used, Lpeak' is equal to 511. Because, by definition, Lpeak' is greater than or equal to Lpeak, the output grayscale value is greater than or equal to the input grayscale value.

As such, when the grayscale value converter 240 converts the input grayscale according to Equation 2, the number of on-subfields corresponding to the converted grayscales increases. This outcome is shown in FIG. 5. FIG. 5 tabulates the subfields of one frame and their respective weight values against the output grayscale values that have been converted by the grayscale value converter 240. The on-subfields are shown as O and the off-subfields are shown as X. The table of FIG. 5 is exemplary like the plot of FIG. 4 and other variations are possible. As shown in FIG. 5, one frame is divided into 10 subfields of SF1 through SF10, and the weight value assigned to each subfield is given as 1 for SF1, 2 for SF2, 4 for SF3, 8 for SF4, 16 for SF5, 32 for SF6, 42 for SF7, 44 for SF8, 52 for SF9, and 54 for SF10. Each grayscale value is generated by on-subfields of an appropriate weight. For example, for grayscale of 0 no subfields are on; for grayscale of 1, only SF1 having a weight of 1 is on; for grayscale of 3, both SF1 and SF2 having a total weight of 3 are on; and for grayscale of 128, SF2, SF4, and SF6-SF8 are on whose combined weights of 2, 8, 32, 42, and 44 add up to 128. When the peak value Lpeak of the input grayscales is given as 128, the grayscale value converter 240 converts the grayscale value 128 into the highest grayscale, that is 255. The grayscale values below 128 are converted according to Equation 2 that grayscale 128 is converted to grayscale 255 and the lower input grayscale values are proportionally increased. As a result, a range of the grayscale values being used is expanded from a region I to a region II in FIG. 5. The number of on-subfields in region II corresponds to the output grayscale values (i.e., the converted grayscale values) of the grayscale value converter 240 and is larger than the number of the input grayscale values in region I.

However, when the grayscale value converter 240 converts the input grayscale value into a higher output grayscale value, the brightness corresponding to the input grayscale value is no longer being correctly expressed. In order to compensate for the change in the brightness due to the grayscale conversion, a second sustain discharge pulse number determiner 250 described below resets the total number of sustain discharge pulses applied during one frame.

The second sustain discharge pulse number determiner 250 resets the total number of the sustain discharge pulses applied during the period of one frame according to the peak value Lpeak received from the peak value detector 230. The second sustain discharge pulse determiner 250, therefore, corrects for the fact that the brightness corresponding to the input grayscale is not expressed when the grayscale values are changed by the grayscale value converter 240. The second sustain discharge pulse number determiner 250 receives the peak value Lpeak from the peak value detector 230 and the first sustain discharge pulse number from the first sustain discharge pulse number determiner 220, changes the first sustain discharge pulse number based on the peak value Lpeak, and finally determines the second sustain discharge pulse number. The second sustain discharge pulse number indicates the total number of sustain discharge pulses actually applied during one frame. In FIG. 3, the second sustain discharge pulse number is expressed by symbols, including sus_apc0', sus_apc1', sus_apc2' . . . sus_apc254', sus_apc255', that are actually numbers.

In order to compensate for the brightness difference between the converted and originally input grayscales, the second sustain discharge pulse number determiner 250 uses Equation 3 to determine the second sustain discharge pulse number according to the peak value Lpeak.

$$\text{sus_apc}' = \frac{\text{sus_apc} \times Lpeak}{Lpeak'} \quad \text{(Equation 3)}$$

In Equation 3, sus_apc is the first sustain discharge pulse number, and sus_apc' is the second sustain discharge pulse number. In addition, Lpeak is the peak value of the input video signal detected by the peak value detector 230, and Lpeak' is the highest grayscale value among the grayscales being used by the PDP. Because, by definition, Lpeak is less than or equal to Lpeak', the second sustain discharge pulse number sus_apc' is obtained often by reducing the first sustain discharge pulse number sus_apc determined by the first sustain discharge pulse number determiner 220.

When the second sustain discharge pulse number determiner 250 finally determines the total number of sustain discharge pulses applied during one frame, according to Equation 3, the brightness of the input grayscales, before having been converted by the grayscale value converter 240, is expressed.

An example illustrative of the above processes follows. In the example, during one frame, the peak value of the input video signal Lpeak is a grayscale value of 128, the highest grayscale Lpeak' is 255, the APC level is given as 200, and the first sustain discharge pulse number sus_apc200 corresponding to the APC level of 200 is 900. Then, the input grayscale value is converted by the grayscale value converter 240 according to Equation 2. Therefore, the input grayscale value of 128 is converted into (255/128)×128=255 as the output grayscale value. Further, according to Equation 3, the second sustain discharge pulse number sus_apc200' allocated to APC level of 200 is given as 900×(128/255)=451.7, that is rounded to 452. So, the grayscale value is increased from 128 to 255 while the number of sustain discharge pulses to be applied during the frame is decreased from 900 to 452. Moreover, if the number of sustain discharge pulses that is now 452 is adjusted again by Equation 3, because after the conversion, the peak value Lpeak is equal to 255, the second sustain discharge pulse number obtained by 452×(255/255)=452 remains at 452. Therefore, although the grayscale value converter 240 converts the input grayscale value to a higher output grayscale value, the second sustain discharge pulse number remains the same for the input grayscale value 128 and the converted grayscale value 255, and accordingly, the same brightness is expressed.

The memory controller 260 generates the subfield data corresponding to the converted grayscale value and rearranges the generated subfield data in address data. The memory controller 260 transmits the address electrode driving control signal to the address electrode driver 300 such that the address data are applied to the address electrodes A1 to Am. The subfield data indicates which subfields are turned on corresponding to the each of the grayscales.

In addition, the scan and sustain electrode driving controller 270 generates a control signal for the scan electrode driver 400 and the sustain electrode driver 500. As a result, the scan electrode driver 400 and the sustain electrode driver 500 apply sustain discharge pulses of the number transmitted from the second sustain discharge pulse number determiner 250 to the scan electrodes Y1 to Yn and the sustain electrodes X1 to Xn.

According to an exemplary embodiment of the present invention, the grayscale of the input video signal is converted so as to increase the number of on-subfields. As the number of on-subfields is increased, the priming particles are increased, thereby enhancing discharge characteristics. In addition, as the number of on-subfields is increased, the difference between the on/off subfields of different grayscales is reduced thereby reducing the appearance of a false contour.

As described above, when the input grayscales are converted to increase the number of the on-subfields corresponding to the grayscale of the input video signal, the discharge characteristics can be enhanced and the perception of a false contour can be reduced.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims and their equivalents.

What is claimed is:

1. A driving method of a plasma display device, the plasma display device being driven by an input video signal during one frame, the one frame being divided into a plurality of subfields, the input video signal of the one frame being divided among the plurality of subfields, each input video signal corresponding to input grayscales, the driving method comprising:

detecting a peak value, the peak value being a highest grayscale among the input grayscales of the input video signal of the one frame;

converting an input grayscale of the one frame corresponding to the peak value to generate a converted grayscale;

applying the converted grayscale to the plasma display device;

detecting a total number of sustain discharge pulses applied during the one frame according to a load ratio as a first sustain discharge pulse number utilizing a first sustain discharge pulse number determiner; and determining a total number of sustain discharge pulses applied during the one frame as a second sustain discharge pulse number in correspondence to the peak value and the first sustain discharge pulse number utilizing a second sustain discharge pulse number determiner.

2. The driving method of claim 1, wherein during the converting the input grayscale, a same number of sustain discharge pulses are allocated for the input grayscale and the converted grayscale.

3. The driving method of claim 1, wherein during the converting the input grayscale, the peak value is converted into a first grayscale, the first grayscale being the highest grayscale among grayscales capable of being used by the plasma display device.

4. The driving method of claim 2, wherein during the converting the input grayscale, the peak value is converted into a first grayscale, the first grayscale being the highest grayscale among grayscales capable of being used by the plasma display device.

5. The driving method of claim 3, wherein during the converting the input grayscale, a second grayscale is converted into a third grayscale, and the third grayscale is obtained from a relationship stating:

the third grayscale=(the first grayscale/the peak value)×the second grayscale.

6. The driving method of claim 4, wherein during the converting the input grayscale, a second grayscale is converted into a third grayscale, and the third grayscale is obtained from a relationship stating:

the third grayscale=(the first grayscale/the peak value)×the second grayscale.

7. The driving method of claim 1, further comprising:

detecting a load ratio of the input video signal of the one frame;

determining a first sustain discharge pulse number in correspondence to the load ratio and the peak value, the first sustain discharge pulse number being a total number of sustain discharge pulses applied during the one frame; and applying the first sustain discharge pulse number to the plasma display device.

8. The driving method of claim 2, further comprising:

detecting a load ratio of the input video signal of the one frame;

determining a first sustain discharge pulse number in correspondence to the load ratio and the peak value, the first sustain discharge pulse number being a total number of sustain discharge pulses applied during the one frame; and applying the first sustain discharge pulse number to the plasma display device.

9. The driving method of claim 7, further comprising:

determining a second sustain discharge pulse number by changing the first sustain discharge pulse number corresponding to the peak value, the second sustain discharge pulse number being a total number of the sustain discharge pulses corresponding to the load ratio, wherein instead of the first sustain discharge pulse number, the second sustain discharge pulse number is applied to the plasma display device.

10. The driving method of claim 9, wherein a first grayscale is the highest grayscale among grayscales capable of being used by the plasma display device and the first sustain discharge pulse number and the second sustain discharge pulse number are related together according to a relationship stating:

the second sustain discharge pulse number=(the first sustain discharge pulse number×the peak value)/(the first grayscale).

11. The driving method of claim 9, wherein the second sustain discharge pulse number is equal to or less than the first sustain discharge pulse number.

12. A plasma display device comprising:

a plasma display panel having a plurality of discharge cells;

a controller for providing a control signal, the control signal driving a plurality of subfields from an input video signal of one frame applied to the controller;

a driver for driving the plasma display panel in response to the control signal;

a first sustain discharge pulse number determiner for detecting a total number of sustain discharge pulses applied during the one frame according to the load ratio as a first sustain discharge pulse number; and a second sustain discharge pulse number determiner for determining a total number of sustain discharge pulses applied during the one frame as a second sustain discharge pulse number in correspondence to the peak value and the first sustain discharge pulse number;

wherein the controller detects a highest grayscale among grayscales of the input video signal of the one frame as a peak value, converts the grayscales of the input video signal of the one frame in correspondence to the peak value to generate converted grayscales, and applies the converted grayscales to the plasma display panel.

13. The plasma display device of claim 12, wherein a same number of sustain discharge pulses is allocated for the grayscales of the input video signal and the converted grayscales.

14. A plasma display device comprising:

a plasma display panel having a plurality of discharge cells;

a controller for providing a control signal, the control signal driving a plurality of subfields from an input video signal of one frame applied to the controller;

a driver for driving the plasma display panel in response to the control signal;

a peak value detector for detecting the peak value;

an automatic power controller for detecting a load ratio of the input video signal of the one frame;

a first sustain discharge pulse number determiner for detecting a total number of sustain discharge pulses applied during the one frame according to the load ratio as a first sustain discharge pulse number;

a grayscale value converter for converting the grayscales of the input video signal of the one frame in correspondence to the peak value; and a second sustain discharge pulse number determiner for determining a total number of sustain discharge pulses applied during the one frame as a second sustain discharge pulse number in correspondence to the peak value and the first sustain discharge pulse number;

wherein the controller detects a highest grayscale among grayscales of the input video signal of the one frame as a peak value, converts the grayscales of the input video signal of the one frame in correspondence to the peak value to generate converted grayscales, and applies the converted grayscales to the plasma display panel.

15. The plasma display device of claim 14, wherein the second sustain discharge pulse number determiner determines the number of second sustain discharge pulses such that a same number of sustain discharge pulses is allocated for the grayscales of the input video signal and the converted grayscales.

16. The plasma display device of claim 14, wherein the second sustain discharge pulse number is equal to or less than the first sustain discharge pulse number.

* * * * *

UNITED STATES PATENT AND TRADEMARK OFFICE

CERTIFICATE OF CORRECTION

PATENT NO. : 7,737,919 B2
APPLICATION NO. : 11/495923
DATED : June 15, 2010
INVENTOR(S) : Seung-Ho Park It is certified that error appears in the above-identified patent and that said Letters Patent is hereby corrected as shown below:

In the Claims

FIG. 5, Sheet 5 of 5

Delete Drawing Sheet 5 and substitute therefore the attached replacement Drawing Sheet 5, which consists of FIG. 5, deleting "Glayscale" and inserting -- Grayscale --

Signed and Sealed this
Fourth Day of October, 2011

David J. Kappos

David J. Kappos
*Director of the United States Patent and Trademark Office*

FIG.5

| Subfield / Weight value / Grayscale | SF1 | SF2 | SF3 | SF4 | SF5 | SF6 | SF7 | SF8 | SF9 | SF10 |
|---|---|---|---|---|---|---|---|---|---|---|
| | 1 | 2 | 4 | 8 | 16 | 32 | 42 | 44 | 52 | 54 |
| 0 | × | × | × | × | × | × | × | × | × | × |
| 1 | ○ | × | × | × | × | × | × | × | × | × |
| 2 | × | ○ | × | × | × | × | × | × | × | × |
| 3 | ○ | ○ | × | × | × | × | × | × | × | × |
| 4 | × | × | ○ | × | × | × | × | × | × | × |
| ... | ... | ... | ... | ... | ... | ... | ... | ... | ... | ... |
| 127 | ○ | × | × | ○ | × | ○ | ○ | ○ | × | × |
| 128 | × | ○ | × | ○ | × | ○ | ○ | ○ | × | × |
| ... | ... | ... | ... | ... | ... | ... | ... | ... | ... | ... |
| 254 | × | ○ | ○ | ○ | ○ | ○ | ○ | ○ | ○ | ○ |
| 255 | ○ | ○ | ○ | ○ | ○ | ○ | ○ | ○ | ○ | ○ |

Lpeak

Lpeak